United States Patent [19]

Edgell et al.

[11] 4,289,072

[45] Sep. 15, 1981

[54] EARTH FRACTURING APPARATUS

[75] Inventors: Thomas A. Edgell, 703 S. College, Apt. #2, Tyler, Tex. 75701; Alfred R. Foote, Winona, Tex.; Charles P. Steele, Hallsville, Tex.

[73] Assignees: Thomas A. Edgell, Tyler; Roberta K. Tillinghast, Houston; James W. Fair, Tyler, all of Tex. ; a part interest

[21] Appl. No.: 103,109

[22] Filed: Dec. 13, 1979

[51] Int. Cl.[3] ..... E21B 43/11

[52] U.S. Cl. ..... 102/318; 102/310; 102/320; 166/63; 175/4.6

[58] Field of Search ..... 102/24 HC, 20, 21.6, 102/21, 23, DIG. 2; 166/297, 308, 55, 63; 175/4.6

[56] References Cited

U.S. PATENT DOCUMENTS

| | | | |
|---|---|---|---|
| 2,775,940 | 1/1957 | Klotz | 102/21.6 X |
| 2,831,429 | 4/1958 | Moore | 102/21.6 X |
| 2,843,041 | 7/1958 | Stewart | 102/24 HC X |
| 3,080,005 | 3/1963 | Porter | 166/55.1 X |
| 3,422,760 | 1/1969 | Mohaupt | 102/21.6 |
| 3,651,760 | 3/1972 | Held | 102/21.6 X |
| 3,762,326 | 10/1973 | Edgell et al. | 102/20 |
| 4,064,935 | 12/1977 | Mohaupt | 166/63 |
| 4,160,412 | 7/1979 | Snyer et al. | 102/24 HC X |
| 4,179,991 | 12/1979 | Echols et al. | 102/21.6 |
| 4,184,430 | 1/1980 | Mock | 102/24 HC X |

*Primary Examiner*—David H. Brown

*Attorney, Agent, or Firm*—Cushman, Darby & Cushman

[57] ABSTRACT

An explosive-containing casing is provided with a cap to which a nipple is secured. The nipple supports a rigid rod which extends the length of the casing and which in turn supports a detonation train for the explosives within the casing. An electrical connector arrangement is joined to the nipple to permit a conductive path to be established to a detonator which forms part of the detonation train. The nipple is secured to the cap in a manner which prevents the entry of water or other undesirable substances into the casing.

12 Claims, 3 Drawing Figures

EARTH FRACTURING APPARATUS

BACKGROUND OF THE INVENTION

The invention is concerned with an explosive device utilized to fracture earth strata adjacent a borehole to thereby increase the permeability of the earth in order to improve the flow rate of oil or gas being recovered from the earth.

The invention is particularly directed to an earth fracturing apparatus of the type described in U.S. Pat. No. 4,160,412 which was granted to William H. Snyder, Ralph E. Williams and John Wisotski on July 10, 1979. The device therein disclosed comprises an elongated cylindrical casing having a centrally located charge and additional charges positioned at opposite ends of the casing. The central charge is detonated to cut through the casing whereby the explosive forces act on the surrounding strata of the earth. Either simultaneously with the central charge detonation or after a slight delay, the end charges simultaneously are detonated to reinforce the explosive forces of the central charge.

In order to achieve proper detonation of the several charges, it is necessary that the integrity of the charges and their detonation train be maintained. The present invention provides means for accomplishing this objective by positively supporting the detonation train within the casing and preventing the entry of water or foreign substances into the casing.

SUMMARY OF THE INVENTION

For preventing entry of water into the interior of the casing thereby disabling the charges and the detonation train therefor, the present invention includes a nipple which is connected to the top cap of the casing. The nipple is provided with a projecting portion which extends within a recess in the top cap, the mating surfaces of the nipple and top caps being provided with seals to prevent the passage of water to the casing's interior. The projecting portion of the nipple serves as a support for a rigid metallic member which extends the length of the casing and which carries a detonation train for the charges. An electrical conductor also is supported by and passes through the nipple to allow a circuit to be established from a power source at the earth's surface to a detonator within the casing.

The invention will be described in further detail in the following description of the invention, reference being made to the accompanying drawings wherein.

DETAILED DESCRIPTION OF THE INVENTION

The present invention is directed to improvements in the earth fracturing apparatus described in the above-identified U.S. Pat. No. 4,160,412. To the extent the apparatus disclosed herein corresponds to that set forth in U.S. Pat. No. 4,160,412, reference is made to said patent for the structural details of the apparatus and its manner of operation.

Figure 1:
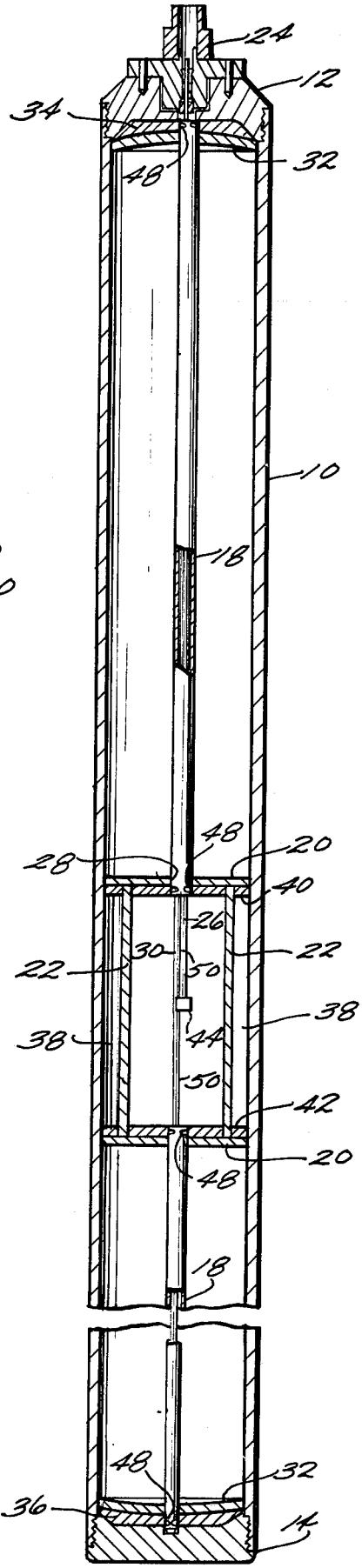
FIG. 1 is a vertical view, partially in section, of an earth fracturing apparatus according to the present invention.
Figure 2:
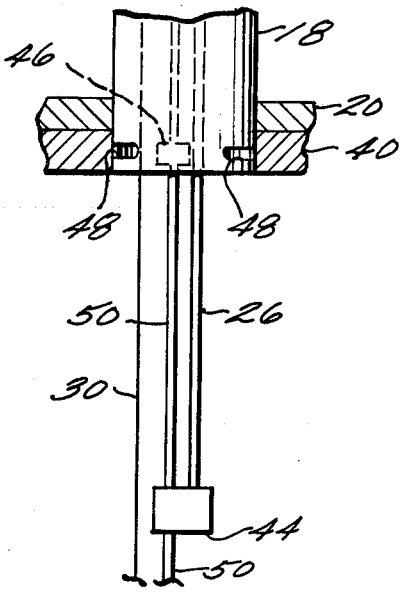
FIG. 2 is an enlarged sectional view of a portion of the apparatus shown in FIG. 1.

Referring now to FIGS. 1 and 2, the earth fracturing apparatus comprises a cylinder 10 formed of a frangible material, such as aluminum, having internal threaded portions at opposite ends thereof for receiving a top end cap 12 and a bottom end cap 14. The caps are screwed onto the cylinder to close its end. Typically, the cylinder 10 has a diameter of approximately 3½" and a length of about 6'.

Figure 3:
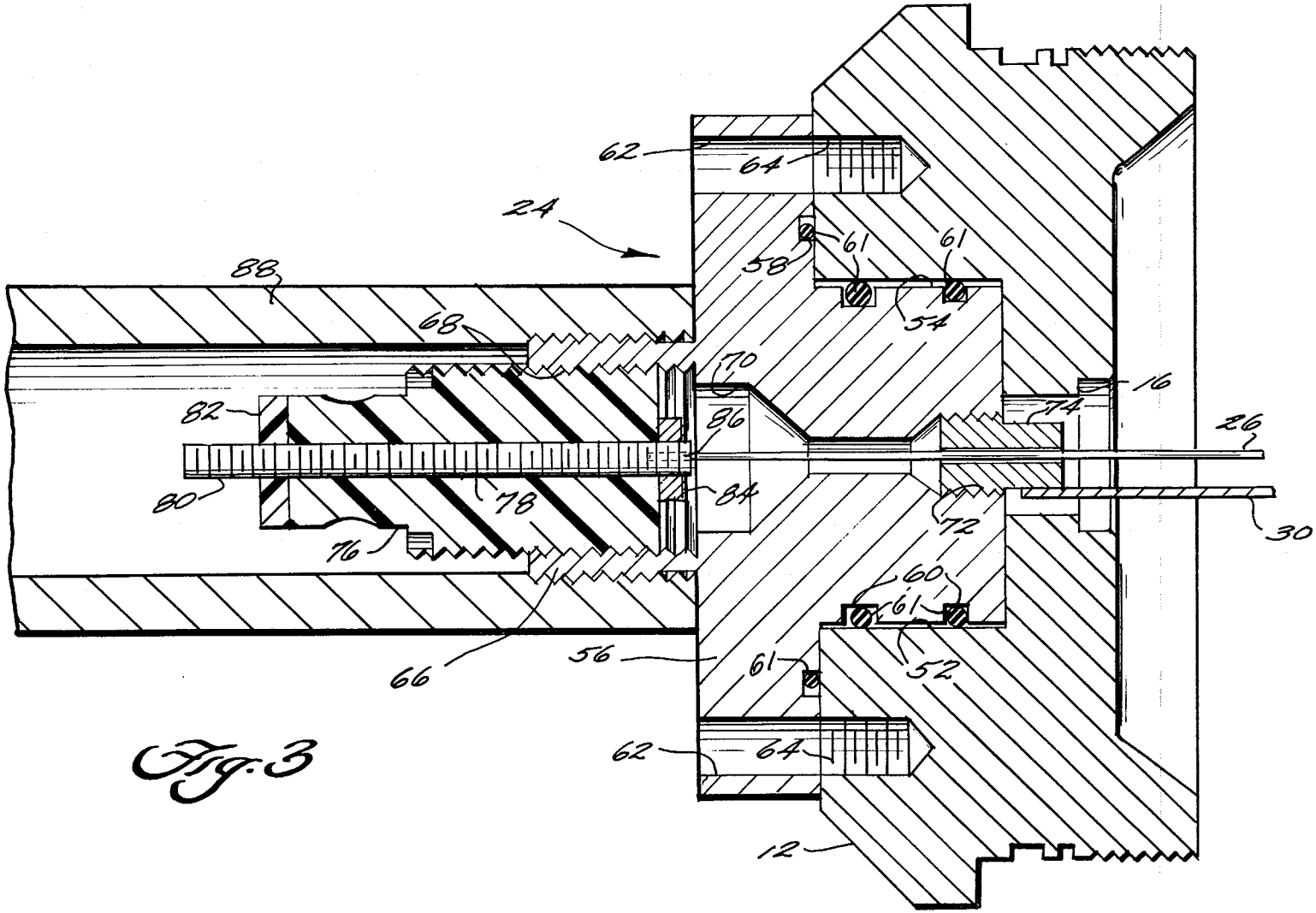
FIG. 3 is an enlarged sectional view of the top cap and nipple arrangement shown in FIG. 1.

Each of the caps 12 and 14 is provided with a shouldered recess of the type indicated by numeral 16 in the depiction of the top end cap 12 in FIG. 3. Each recess receives an end of a guide tube 18 formed of a suitable material, such as aluminum. The opposite ends of the guide tubes are secured to the centers of respective buffer plates 20, each plate having a diameter corresponding to the inner diameter of cylinder 10 and being provided with an aperture coaxially aligned with tube 18. The buffer plates maintain the axes of the guide tubes 18 in coaxial relationship in positions lying along the longitudinal axis of the cylinder. The buffer plates are maintained a prescribed distance apart by spacer bars 22 which extend between the plates and which are joined thereto, as by threaded connections.

A nipple 24 is secured to the exterior of the top end cap 12. A detailed description of the nipple will be presented hereinafter. However, for present purposes, it will be explained that an electrically conductive wire 26, such as a 22 gauge AWG wire, is joined at one of its ends to nipple 24 and extends within the top guide tube 18 and through the central aperture 28 formed in the upper buffer plate 20 to a location substantially midway between the ends of the cylinder 10.

A rod 30, fabricated from a conductive material, such as brass, also is supported by the nipple 24. Rod 30 is positioned within tubes 18 and extends the length of the cylinder. At selected locations along the tubes, exterior grooves (not shown) are formed therein to receive annular snap rings which divide the interior of the cylinder 10 into separate chambers. More particularly, snap rings 32 located near the ends of the cylinder define narrow chambers which receive sheets 34 and 36 of explosive material, such as the well known and commercially available product designated as Detasheet which is produced by E. I. duPont de Nemours.

Conventional linear-shaped primary charges 38 are located within the chamber formed by plates 20. These charges extend between explosive sheets 40 and 42 which are retained in place by the buffer plates, the spacer bars 22 and the charges 38.

The brass rod 30 is provided with recesses along its length at positions corresponding to the locations of the sheets of Detasheet and at the center of the chamber which contains the linear charges 38. At the latter location, the recess in the rod receives an electric detonator 44 whereas the remaining recesses receive booster caps 46 (e.g., see FIG. 2). The guide tubes 18 are provided with windows 48 at points along their length which are adjacent to caps 46.

The free end of wire 26 is joined to the electric detonator 44, the detonator being grounded through rod 30 and nipple 24, as will be described hereinafter. Lengths of prima cord 50 extend along rod 30 from detonator 44 to the booster caps 46, the prima cord being secured to the rod by conventional means such as waxed line.

In operation, with the cylinder 10 lowered within a borehole and an electrical connection established from a power source located at the earth's surface to the wire 26, the electric detonator 44 is actuated by the completion of a circuit from the power source through the detonator. The prima cord 50 thus is ignited to cause the booster caps 46, and in turn the adjacent explosive sheets 40 and 42, to detonate thereby setting off charges 38. The charges being of linear shape and being aligned parallel to the longitudinal axis of the cylinder 10, the explosive forces of the charges are focused in a radially outward direction to cut through the cylinder, through the pipe lining, the borehole and through any grout holding the well pipe in place, thereby fracturing the surrounding earth in the manner described in U.S. Pat. No. 4,160,412. Simultaneously, or after a delay established by the time required for the lengths of prima cord 50 to burn to their ends, the booster caps 46 adjacent the explosive sheets 34 and 36 are detonated to set off sheets 34 and 36. The resultant explosive forces are concentrated at the center of the cylinder to supplement the earth fracturing effect of the primary charge thereby enlarging the fractures. This reinforcement of the explosive forces also is detailed in U.S. Pat. No. 4,160,412.

Referring now to FIG. 3, the details of the nipple 24 and its relationship to cap 12 will be described. The cap is provided at its upper surface with a recess 52 which meets with recess 16 to provide an aperture through the cap. Recess 52 receives a portion 54 of nipple 24 which projects from an annular flange portion 56. The surface of flange 56 which mates with cap 12 is provided with an annular groove 58. Additionally, the projecting portion 54 of the nipple is provided with spaced circumferential grooves 60. The grooves 58 and 60 receive O-rings 61 so that when nipple 24 is secured to the top cap 12 by suitable fasteners extending within the aligned boreholes 62 and 64 in the nipple and the cap, a seal is formed to prevent water or other foreign materials from passing along the mating surfaces of nipple 24 and cap 12 to the interior of casing 10.

The nipple 24 also is provided with a further projecting portion 66 on the opposite side of flange 56 from portion 54. Portion 66 is threaded on its exterior surface and is provided with an internally threaded aperture 68 which is axially aligned with apertures 70 and 72 in flange 56 and projection 54, respectively. When the nipple 24 is secured to top cap 12, the apertures 68, 70 and 72 are aligned with the aperture in the cap formed by recesses 52 and 16.

The projecting portion 54 is at least partially internally threaded along aperture 72 to receive a threaded plug 74. The rod 30 is rigidly secured to a projecting portion of the plug which extends into recess 16 of the top cap. Consequently, the rod and the detonation train supported thereby are positively positioned and retained with respect to casing 10 when nipple 24 is secured to the top cap 12.

On the opposite side of nipple 24 from plug 74 a threaded element 76 formed of an electrically nonconductive material is screwed into the threaded aperture 68 of projecting portion 66. Element 76 is provided with an internal passage 78 which is axially aligned with apertures 70 and 72 of the nipple when the element 76 is joined with portion 66. Passage 78 receives a threaded member 80 formed of an electrically conductive material. Member 80 is dimensioned to project beyond the ends of element 76 and is secured with respect thereto by means of a nut 82 of nonconductive material at one end of the element 76 and a conductive nut 84 at the opposite end. The end of member 80 adjacent nut 84 is provided with a recess 86 to receive the end of wire 26, the wire being secured to member 80 by suitable means such as soldering.

A conventional cylindrical coupler 88 is provided with internal threading at one end thereof to permit the coupler to be secured to nipple 24 by being screwed onto the exterior threaded surface of nipple portion 66. This connection prevents entry of water or other substances to the interior of coupler 88 via the connection between the coupler and the nipple.

By means well known in the art, the coupler 88 is secured to means at the earth's surface which permits the casing 10 to be lowered into the borehole to the desired depth. Such conventional means also includes an electrical conductor which is joined at one of its ends to member 80 and at its other end to a power source at the surface. With the coupler being electrically grounded in conventional fashion, this arrangment permits a circuit to be selectively completed from the power source through member 80, wire 26, detonator 44, rod 30, plug 74, nipple 24 and the coupler 88 when it is desired to set off detonator 44.

From the description which has been presented, it is apparent that the invention provides an improved means for supporting the detonation train in a precise manner within the casing while simultaneously providing a dependable electrical path to the detonation train and preventing water or other substances from entering the casing.

We claim:

1. An improved earth fracturing apparatus of the type having an elongated casing containing a laterally directed charge located at a central portion of said casing and additional explosive devices positioned on opposite sides of said charge, said improvement comprising:

a rod positioned within said casing and extending longitudinally thereof;

means for supporting said rod at one end of the casing;

a plurality of detonating means supported by said rod, said detonating means being spaced along said rod at positions adjacent said additional explosive devices; and means for actuating said detonating means to set off the additional explosive devices and the laterally directed charge.

2. An apparatus as set forth in claim 1, wherein said additional explosive devices are explosive sheets, the improvement further comprising:

a first guide tube positioned within the casing and extending longitudinally thereof from said one end;

a first plate joined to said guide tube at a location adjacent one of said explosive sheets for retaining said one sheet adjacent one side of the laterally directed charge;

a second guide tube positioned within the casing and extending from the opposite end thereof in substantial axial alignment with said first guide tube;

a second plate joined to said second guide tube at a location adjacent a second explosive sheet for retaining said second sheet adjacent the opposite side of the laterally directed charge; and said rod being positioned within the first and second guide tubes and passing through apertures in said first and second plates.

3. An apparatus as set forth in claim 2, further comprising:

window means provided in said tubes adjacent the respective explosive sheets and detonating means.

4. An apparatus as set forth in claim 3, further comprising:

an additional explosive sheet positioned at each end of said casing, said guide tubes being provided with additional window means adjacent the additional explosive sheets;

still further detonating means supported by the rod adjacent the additional window means; and means joining the further detonating means to the actuating means.

5. An apparatus as set forth in claim 1, wherein said actuating means includes:

an electrically actuated detonator supported by said rod substantially centrally of the length of said casing; and lengths of prima cord supported by the rod and extending from the detonator to said plurality of detonating means positioned adjacent the additional explosive devices.

6. An apparatus as set forth in claim 1, wherein said means for supporting the rod comprises:

a nipple removably joined to said one end of the casing; and means for rigidly securing said rod to the nipple.

7. An apparatus as set forth in claim 6, wherein said nipple is provided with an aperture communicating with the interior of the casing, said securing means comprising a plug joined to said rod and retained within said aperture.

8. An apparatus as set forth in claim 7, wherein said actuating means includes:

an electrically actuated detonator supported by said rod; and an electrical conductor passing through said nipple aperture and through a passageway in said plug, said conductor being connected to the detonator to permit the detonator to be set off in response to a flow of current in said conductor.

9. An apparatus as set forth in claim 1, wherein said means for supporting the rod comprises:

a cap secured to said one end of the casing and having an aperture therein;

a nipple removably joined to said cap and having an aperture therein coaxially related to the aperture in said cap;

a plug retained within the apertures of said cap and nipple, said rod passing through the aperture of the cap and being secured to the plug; and sealing means positioned between mating surfaces of the nipple and the cap.

10. An apparatus as set forth in claim 9, wherein said actuating means includes:

an electrically actuated detonator supported by said rod; and an electrical conductor passing through the apertures of said nipple and the cap and through a passageway in said plug, said conductor being connected to the detonator to permit the detonator to be set off in response to a flow of current in said conductor.

11. An apparatus as set forth in claim 10, further comprising:

an electrically nonconductive element joined to said nipple at an end of said nipple aperture opposite that in which said plug is retained;

an electrically conductive member passing through said nonconductive element and having an end projecting within said nipple aperture; and means joining an end of said electrical conductor to the projecting end of said conductive member.

12. An improved earth fracturing apparatus of the type having an elongated casing containing a laterally directed charge located at a central portion of said casing and explosive sheets positioned on opposite sides of said charge and adjacent the ends of the casing, said improvement comprising:

a cap secured to one end of the casing and having an aperture therein;

a nipple removably joined to said cap and having an aperture therein coaxially related to the aperture in said cap;

a plug retained within the apertures of said cap and nipple;

a first guide tube positioned within the casing and extending longitudinally thereof from said one end;

a first plate joined to said guide tube at a location adjacent a first one of said explosive sheets for retaining said one sheet adjacent one side of the laterally directed charge;

a second guide tube positioned within the casing and extending from the opposite end thereof in substantial axial alignment with said first guide tube;

a second plate joined to said second guide tube at a location adjacent a second one of said explosive sheets for retaining said second sheet adjacent the opposite side of the laterally directed charge;

a rod positioned within the first and second guide tubes and passing through apertures in said first and second plates, said rod passing through the aperture of the cap and being secured to the plug;

a plurality of detonating means supported by said rod, said detonating means being spaced along said rod at positions adjacent said explosive sheets;

window means provided in said tubes adjacent the respective explosive sheets and detonating means;

an electrically actuated detonator supported by said rod substantially centrally of the length of said casing;

lengths of prima cord supported by the rod and extending from the detonator to said plurality of detonating means;

an electrical conductor passing through said nipple aperture and through a passageway in said plug, said conductor being connected to the detonator to permit the detonator to be set off in response to a flow of current in said conductor;

an electrically nonconductive element joined to said nipple at an end of said nipple aperture opposite that in which said plug is retained;

an electrically conductive member passing through said nonconductive element and having an end projecting within said nipple aperture;

means joining an end of said electrical conductor to the projecting end of said conductive member; and sealing means positioned between mating surfaces of the nipple and the cap.

* * * * *